United States Patent [19]

Firey

[11] Patent Number: 4,580,402

[45] Date of Patent: Apr. 8, 1986

[54] TORQUE LEVELLER AND GOVERNOR

[76] Inventor: Joseph C. Firey, P.O. Box 15514, Seattle, Wash. 98115-0514

[21] Appl. No.: 672,122

[22] Filed: Jan. 7, 1985

[51] Int. Cl.[4] ..... F01B 21/04

[52] U.S. Cl. ..... 60/711; 60/716; 290/4 C

[58] Field of Search ..... 60/698, 711, 716; 290/4 C

[56] References Cited

U.S. PATENT DOCUMENTS

| | | | |
|---|---|---|---|
| 2,647,372 | 8/1953 | Fell | 60/711 |
| 3,548,596 | 12/1970 | Mizushina et al. | 60/711 |
| 4,137,721 | 2/1979 | Glennon et al. | 60/711 |
| 4,433,547 | 2/1984 | Firey | 60/711 |

*Primary Examiner*—Allen M. Ostrager

[57] ABSTRACT

Governor devices are described for use on single or multi-engine plants, some of whose engines or whose load experiences periodic torque variations, which act upon the torque regulator of at least one of the engines to maintain engine torque equal to load torque and to maintain shaft speed essentially constant.

6 Claims, 5 Drawing Figures

TORQUE LEVELLER AND GOVERNOR

CROSS REFERENCE TO RELATED APPLICATIONS

The invention described herein is well suited for use as a governor for engines of various kinds, for example those described in my following earlier U.S. patent applications:

(1.) "Improved Cyclic Char Gasifier," Ser. No. 06/492,484, filing date 6 May 1983, Group Art Unit 173.

(2.) "Additionally Improved Cyclic Char Gasifier," Ser. No. 06/552,398, filing date 16 Nov. 1983.

(3.) "Cyclic Velox Boiler," U.S. Pat. No. 4,455,837.

(4.) "Cyclic Velox Boiler," Ser. No. 06/579,562, filing date 13 Feb. 1984, now allowed, process divisional of U.S. Pat. No. 4,455,837.

BACKGROUND OF THE INVENTION

1. Field of the Invention

This invention is in the field of torque governing and speed governing of engines and particularly for engines whose torque and power varies appreciably over a period of several cycles or revolutions.

2. Description of the Prior Art

The description of the prior art is essentially the same as the description of the prior art in my U.S. Pat. No. 4,433,547, issued 28 Feb. 1984, and this material is incorporated herein by reference thereto. The additional references cited for U.S. Pat. No. 4,433,547, are also relevant prior art.

Summary of the Invention

The devices of this invention are governors used on engine plants comprising one or more engines coupled to a common power output shaft and with at least one of the engines being equipped with a torque regulator. These governors comprise: an engine torque sensor on the engine side of a flywheel and a load torque sensor on the load side of this governor flywheel; a speed sensor to sense the speed of the common power output shaft; a comparator to compare engine torque against load torque; a comparator to compare shaft speed against a set speed; these comparators are operative upon a controller which adjusts the engine torque regulator to maintain engine torque equal to load torque and to maintain shaft speed equal to set speed. Various types of engines, couplings, torque regulators, torque sensors, speed sensors, flywheels, comparators, and controllers can be used and in various combinations.

A principal beneficial object of this invention is to hold the torque and speed output of an engine plant steady even though the torque output of one or some of the engines of the plant or the load on the plant varies periodically. An additional beneficial object of this invention is to govern the engine plant directly in response to torque variations of either the engines or the load and in this way to more quickly correct the torque regulator for torque changes.

Figure 2:
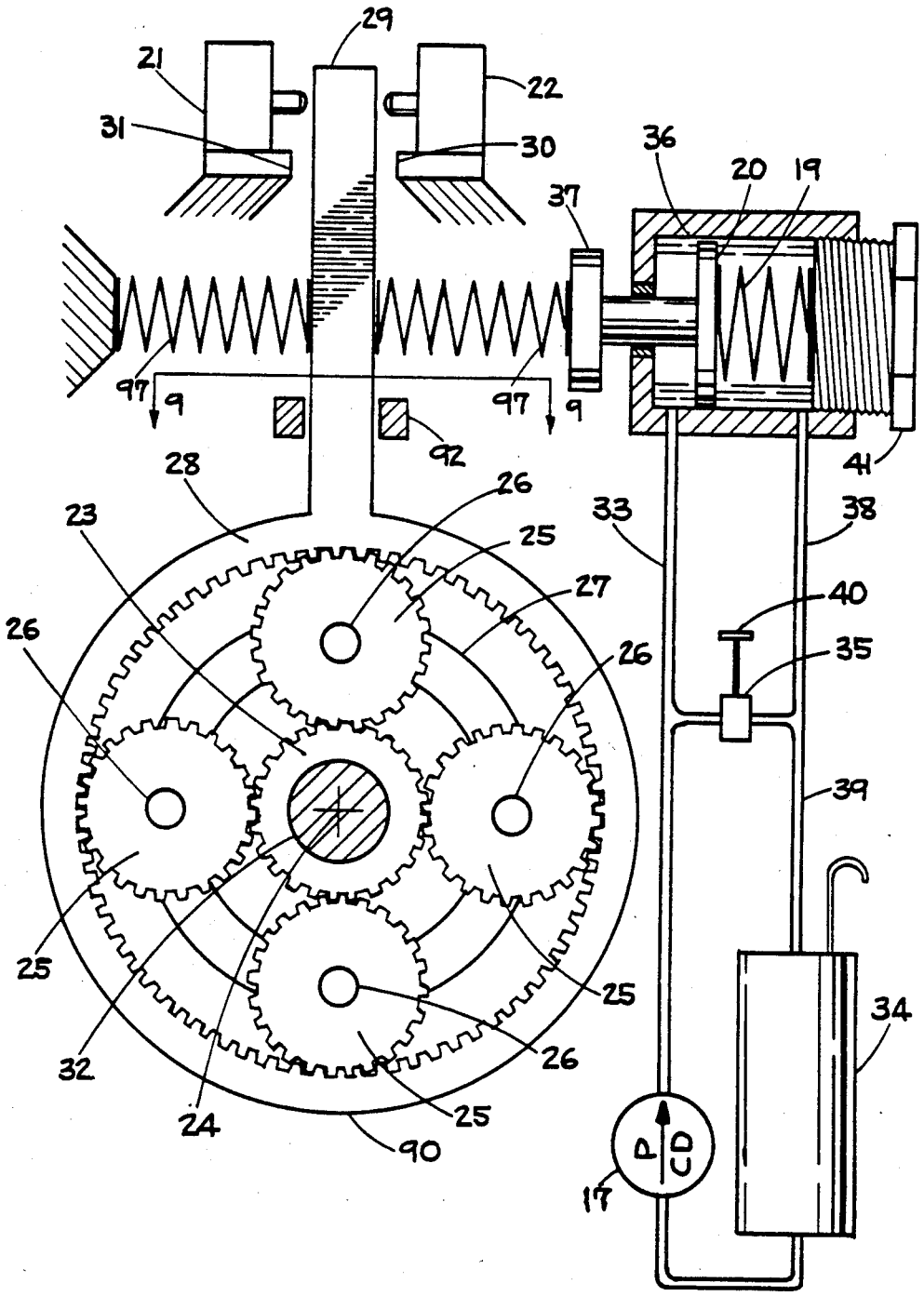
Figure 3:
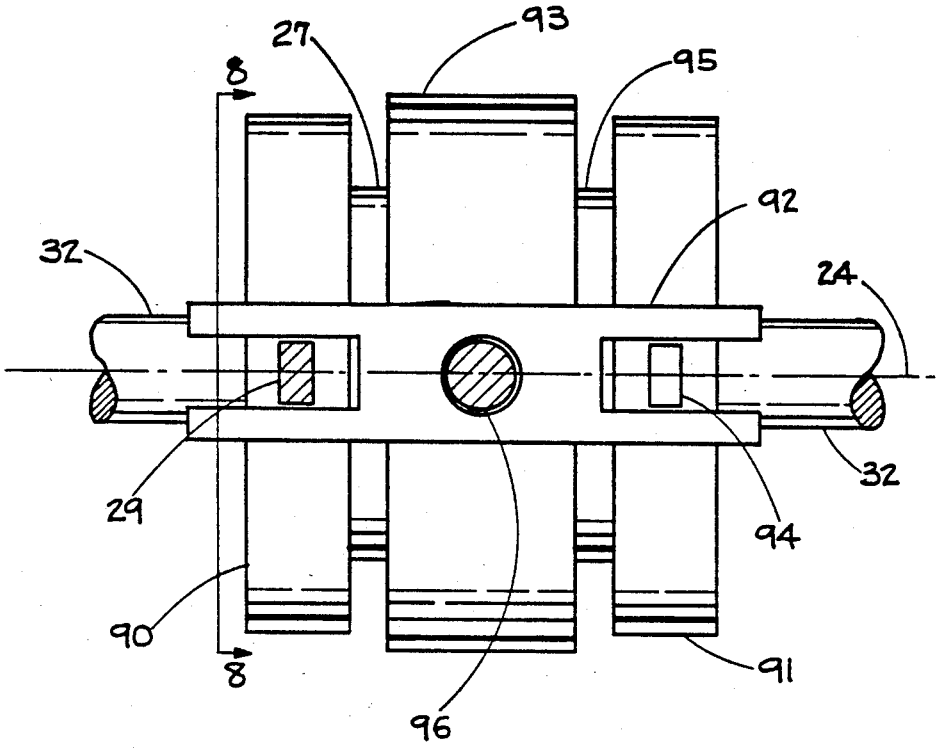

An example mechanical and hydraulic governor of this invention is shown in FIGS. 2 and 3.

Figure 4:
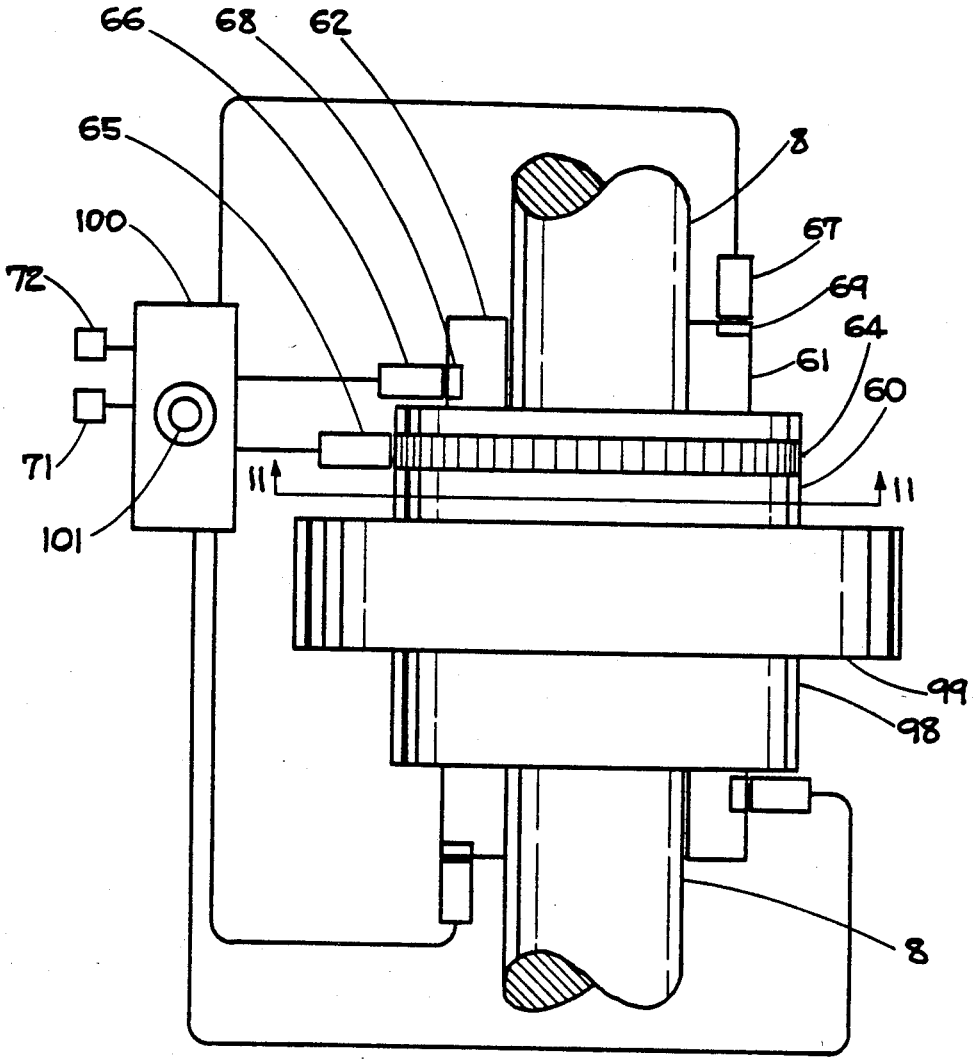
Figure 5:
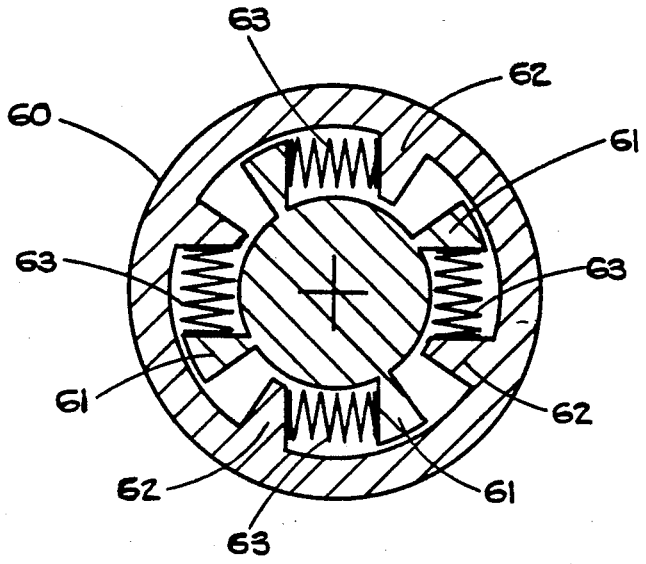

An example electrical and electronic governor of this invention is shown in FIGS. 4 and 5.

DESCRIPTION OF THE PREFERRED EMBODIMENTS

The invention described herein is an engine torque and speed governor for use on single or multiple engine plants with a common final power output shaft, some of whose engines experience periodic torque variations. The governor of this invention can be used to maintain the speed of the common final power output shaft more nearly constant by more quickly matching engine shaft torque output to load torque than does my earlier torque leveller described in U.S. Pat. No. 4,433,547, and this is a principal beneficial object of this invention. As described in U.S. Pat. No. 4,433,547, column 10, lines 6 through 31, load torque variations produce a delayed response of the torque leveller of U.S. Pat. No. 4,433,547, and this is a deficiency of this governor which the invention described herein overcomes. This material of U.S. Pat. No. 4,433,547, column 10, lines 6 through 31, is incorporated herein by reference thereto. A governor of this invention comprises the following elements:

(1) A torque regulator means for regulating the torque output of at least one of the engines, all of which engines are coupled to a single common power output shaft which drives the load;

(2) A flywheel secured rotationally to the common power output shaft between the engines and the load so that the flywheel rotational speed is always a fixed multiple of the rotational speed of the common power output shaft;

(3) A speed sensor means for sensing the rotational speed of the common power output shaft;

(4) A load torque sensor means for sensing the torque in that portion of the common power output shaft between the flywheel and the load;

(5) An engine torque sensor means for sensing the torque in that portion of the common power output shaft between the flywheel and the engines;

(6) Comparator and control means responsive to the load torque sensor means, the engine torque sensor means and the speed sensor means and operative upon the torque regulator means so that: when load torque exceeds engine torque the torque regulator is adjusted to increase engine torque; when load torque is less than engine torque the torque regulator is adjusted to decrease engine torque; when shaft speed exceeds set speed the torque regulator is adjusted to decrease engine torque; when shaft speed is less than set speed the torque regulator is adjusted to increase engine torque.

Figure 1:
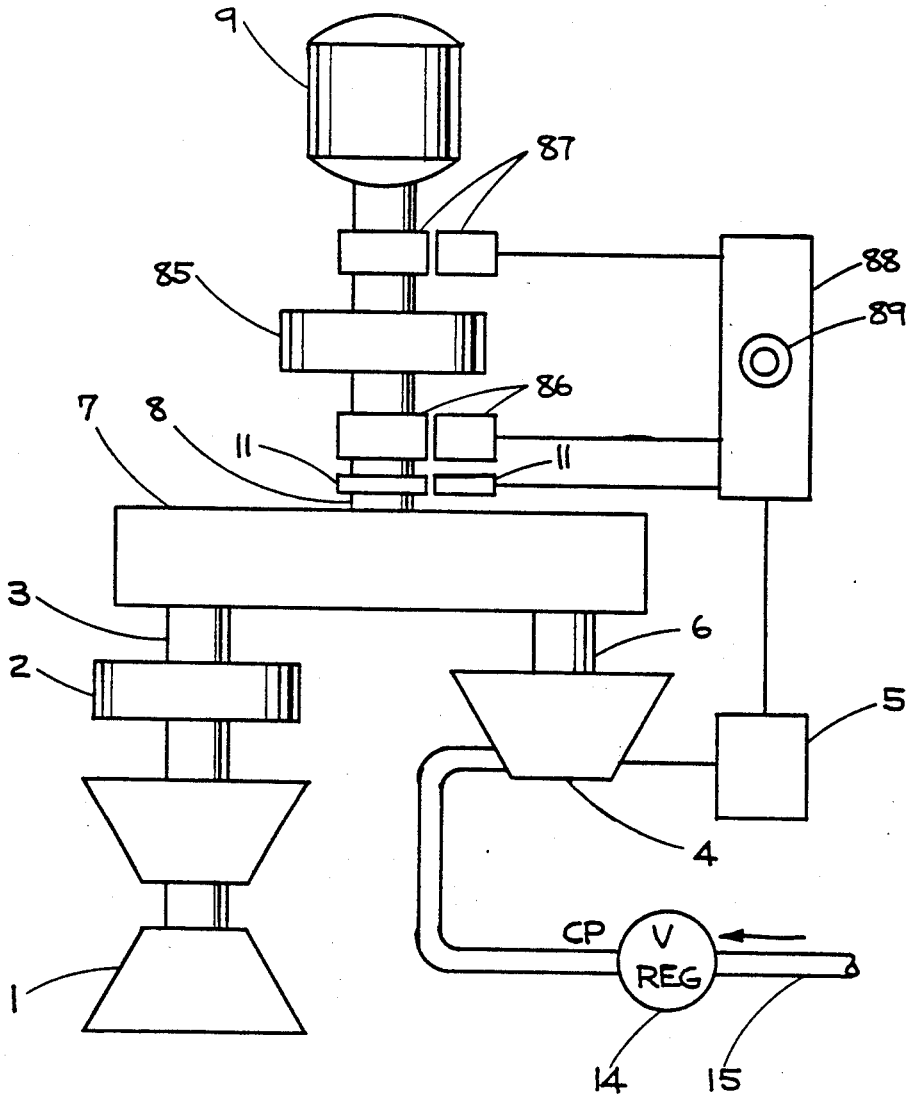
FIG. 1 an engine plant of this invention is shown schematically with a primary engine, 1, a leveller engine, 4, a load, 9, driven by a common power output shaft, 8, upon which a governor of this invention is mounted.

The foregoing elements are the essential elements of a torque leveller and governor of this invention, but additional elements can also be used for particular purposes. For example, a means for adjusting the set speed to which the common power output shaft is controlled may be used in those applications requiring several different speeds for driving the load. One or more dashpots may also be used to slow down governor response to torque variations of a shorter term than the periodic variations such as those produced by in cycle torque variations of one or more of the engines. One particular example of an engine plant of this invention is shown schematically in FIG. 1. A primary engine, 1, fitted with a flywheel, 2, may experience torque and power variations in its power output shaft, 3. A leveller engine 4, with a torque regulator, 5, has its power output shaft, 6, coupled into the same gearbox, 7, to which the primary engine power output shaft, 3, is also coupled. The thusly combined torque and power output of the primary engine, 1, and the torque leveller engine, 4, are delivered from the gearbox, 7, via the common final power output shaft, 8, which in turn drives the load, 9, of the engine plant, such as an electric generator. A speed sensor, 11, measures the speed of the common power output shaft, 8. The governor flywheel, 85, is secured rotationally to the common power output shaft, 8, as by keys or splines. An engine torque sensor, 86, measures the torque in that portion of the common power output shaft, 8, between the governor flywheel, 85, and the engines, 1, 4. A load torque sensor, 87, measures the torque in that portion of the common power output shaft, 8, between the governor flywheel, 85, and the load. 9. A comparator and controller, 88, compares engine torque at, 86, against load torque at, 87, and acts upon the torque regulator, 5, to increase leveller engine, 4, torque when load torque exceeds engine torque, and to decrease leveller engine, 4, torque when engine torque exceeds load torque. The comparator and controller, 88, also compares sensed speed of shaft, 8, against a set speed value and acts upon the torque regulator, 5, to increase leveller engine torque when sensed speed is below set speed and to decrease leveller engine torque when sensed speed exceeds set speed. The set speed value can be fixed and non-adjustable or can be adjustable, as by hand, via a speed adjustor, 89, on the controller, 88. A gearbox coupling, 7, between the primary engine power output shaft, 3, the leveller engine power output shaft, 6, and the common final power output shaft, 8, is shown in FIG. 1, but other types of couplings can be used such as direct coupling on a single common shaft, hydraulic coupling via hydraulic pumps and motors, electric coupling via electric generators and motors, etc. An added flywheel, 2, is shown for the primary engine, 1, but this may not always be needed if the in-cycle torque variations of the primary engine are very small, as with a turbine engine. In FIG. 1, the leveller engine, 4, is shown receiving a constant pressure driving fluid supply, such as fuel gas or high-pressure steam, via a constant pressure regulator, 14, from a supply pipe, 15, and with the torque regulator, 5, acting to adjust inlet flow area, such as turbine nozzle inlet area, in order to adjust the torque output of the leveller engine, 4. But the torque regulator, 5, of the leveller engine, 4, can alternatively function in other ways as by adjusting the pressure of the driving fluid, or by adjusting the flow rate of the leveller engine fuel, etc., as described in the Description of the Prior Art. The leveller engine, 4, is shown in FIG. 1 as a separate engine but can alternatively be integral with the primary engine, 1, as, for example: a portion of the cylinders of a primary multicylinder internal combustion engine with the torque regulator of this portion separate from that of the remaining primary engine cylinders: a separately controlled group of nozzles in a primary turbine engine.

The leveller engine, 4, can be any type of engine, such as those described in the Description of the Prior Art, and should have a maximum power generating capacity at least equal to the maximum difference between the power output of the primary engine, 1, and the power required to drive the external load, 9. The power output of the leveller engine, 4, should also be adjustable, via the torque regulator, 5, between its maximum value and either zero or at least the minimum difference between the power output of the primary engine, 1, and the power required to drive the external load, 9.

Alternatively, the governor of this invention can be used on a single engine, which is equivalent to the absence of the primary engine, 1, from the FIG. 1 form of this invention.

The operation of the FIG. 1 form of this invention can be described as follows. When the torque output of the primary engine, 1, decreases periodically, so also then does the torque in that portion of the common final output shaft, 8, between the engines and the flywheel, 85. But, since load torque has not changed, a difference of torque exists across the flywheel, 85, tending to accelerate the flywheel and thus change the speed of the common output shaft, 8.

This difference of sensed torque between the engine torque sensor, 86, and the load torque sensor, 87, causes the comparator and controller, 88, to operate upon the leveller engine torque regulator, 5, to increase leveller engine torque, until engine torque matches load torque. The reverse control effects occur when the torque output of the primary engine, 1, increases. When the speed of the common final output shaft, 8, decreases below set speed the speed sensor, 11, acts via the controller, 88, and the torque regulator, 5, to increase the torque output of the leveller engine, 4, until the speed of the common final ouput shaft is restored to set value. The reverse control effects occur when the shaft speed increases.

In this way a torque leveller and governor of this invention acts to keep the common output shaft speed essentially constant at the set value by keeping engine torque essentially equal to load torque. Additionally, a torque leveller and governor of this invention responds promptly and correctly to an increase or decrease of load torque by correspondingly increasing or decreasing engine torque. This latter result is an improvement of response characteristics as compared to my torque leveller of U.S. Pat. No. 4,433,547 which responded initially wrongly to changes of load torque.

Any of various different kinds of speed sensors and torque sensors can be used, and in various combinations, for the purposes of this invention. Several such suitable speed sensors and torque sensors are described in my U.S. Pat. No. 4,433,547, on: column 5 line 19 through line 54; column 6 line 12 through column 8 line 9; column 8 line 57 through column 9 line 36; and this material is incorporated herein by reference thereto.

Any of various different kinds of engine torque regulators can be used, and in various combinations, for the purposes of this invention. Several suitable examples of torque regulators are described in my U.S. Pat. No. 4,433,547 on: column 2 line 28 through line 46; column 8 line 10 through line 56; column 9 line 37 through column 10 line 5; and this material is incorporated herein by reference thereto.

The comparator and controller element, 88, comprises two comparators, one to compare engine torque against load torque, the other to compare shaft speed against set speed, and one controller to operate upon the engine torque regulator, 5, to increase or decrease engine torque. Hence, the results of the two comparators are to be combined into a single control result. This combining of the two comparator results into a single control result can be carried out in at least two different ways:

(1.) The torque comparator means can compare load torque to engine torque and control the torque regulator means so that: when load torque exceeds engine torque plus a speed correcting torque, the torque regulator is adjusted to increase engine torque; when load torque is less than engine torque plus a speed correcting torque, the torque regulator is adjusted to decrease engine torque. The speed comparator means can compare sensed speed of the common power output shaft to set speed and control the speed correcting torque so that: when shaft speed exceeds set speed, the speed correcting torque acts in the same direction as engine torque and is increased as excess speed increases; when shaft speed is less than set speed, the speed correcting torque acts oppositely to engine torque and is increased as speed deficiency increases. This scheme uses the torque comparator as the primary control acting on the engine torque regulator with the speed comparator acting to adjust this primary control.

(2.) The speed comparator means can compare sensed speed of the common power output shaft to set speed plus a torque correction speed and control the torque regulator means so that: when shaft speed exceeds set speed plus a torque correction speed, the torque regulator is adjusted to decrease engine torque; when shaft speed is below set speed plus a torque correction speed, the torque regulator is adjusted to increase engine torque. The torque comparator means can compare load torque to engine torque and control the torque correction speed so that: when load torque exceeds engine torque, the torque correction speed is positive and is increased positively as engine torque deficiency increases; when engine torque exceeds load torque, the torque correction speed is negative and is increased negatively as engine torque excess increases. This scheme uses the speed comparator as the primary control acting on the engine torque regulator with the torque comparator acting to adjust this primary control.

One particular example of a portion of this invention is shown in FIG. 2 and 3 and comprises two transmission torque sensors, 90, 91, of mechanical epicyclic geared type, a direct speed sensor, 17, of the shaft driven hydraulic pump and flow restrictor type, a comparator lever, 92, for torque comparison, a spring comparator, 19, for speed comparison, a hydraulic actuator, 20, for adjustment of the speed correcting torque value, a flywheel, 93, secured rotationally to the common power output shaft, 32, via the planetary train arms, and electric switch (or pneumatic or hydraulic valve) actuators, 21, 22, for adjustment of the leveller engine torque regulator. The epicyclic torque sensors, 90, 91, each comprise a sun gear, 23, rotated by the common final driving shaft, 32, about its centerline, 24, planetary gears, 25, rotatable on their planetary shafts, 26, with these planetary shafts secured to the trains arms, 27, 95, which are secured to and rotate with the flywheel, 93, whose centerline is coincident with the driving shaft centerline 24, and an internal ring gear, 28, prevented from rotating by the torque arms, 29, 94, and the stops, 30, 31. As thus shown in FIG. 2, the epicyclic gear train functions as a reduction gear with the speed of the train arm, 27, and hence the flywheel, less than the speed of the sun gear, 23, and hence the driving shaft. This gear train could alternatively function as a flywheel speed increaser by reversing the sun gear and train arm connections. The planetary gears, 25, mesh with both the sun gear, 23, and the stationary ring gear, 28, and thus the force acting upon the torque arm, 29, is proportional to the torque in the driving shafts, 32, and in this way the torque in the common power output shaft is sensed on both the engine side and the load side of the flywheel, 93.

The force in the engine side torque arm, 29, is compared against the force in the load side torque arm, 94, via the comparator lever, 92, which is freely pivoted about the fixed center, 96, positioned equidistantly from these two torque arms, 29, 94. The shaft torque on the engine side of the flywheel, 93, can only differ from the shaft torque on the load side of the flywheel, 93, when angular acceleration of the shaft, 32, is occurring, the difference of these two torques being the torque required to accelerate the flywheel, 93. When engine torque arm force exceeds the load torque arm force plus the upward force of the spring, 97, the torque arm, 29, moves against the stop, 30, and thus closes the reduce switch, 22, which acts upon the leveller engine torque regulator to reduce leveller engine torque output as explained hereinafter. When engine torque arm force is less than the load torque arm force plus the upward force of the spring, 97, the torque arm, 29, moves against the stop, 31, and thus closes the increase switch, 21, which acts upon the leveller engine torque regulator to increase leveller engine torque output. The switches, 21, 22, and the stops, 30, 31, are positioned so that only one of the switches can be closed at a time, the other switch being then open. In this way, the torque sensor and comparator portion of the controller example shown in FIGS. 2 and 3 functions to maintain engine torque equal to load torque, plus any speed correcting torque from the spring, 97.

A positive displacement oil pump of constant displacement, 17, driven at a fixed speed ratio from the common final power output shaft, 32, pumping oil from a reservoir, 34, through a flow restrictor, 35, and through various passages of low flow restriction back to the reservoir, comprise the speed sensor for the particular example of FIG. 2. As shaft speed and hence oil pump speed increase, a greater flow of oil occurs through the flow restrictor, 35, and a greater pressure drop occurs across the restrictor. The reverse effects take place when shaft speed decreases. Thus, the pressure drop across the flow restrictor, 35, is a function of the speed of the common final power output shaft, 32, varying approximately as the square of the shaft speed. Shaft speed is thus sensed as this pressure drop. This pressure drop is applied via the pipes, 33, 38, 39, across the speed comparator piston, 20, in the speed comparator cylinder, 36, which forces the piston, 20, against the speed comparator spring, 19. At set speed the comparator spring, 19, and the comparator piston, 20, are compressed to a set position and the speed correcting torque spring base, 37, secured to the speed comparator piston, 20, then places a zero value of precompression into the speed correcting spring, 97. When the speed of the shaft, 32, increases above set value, the resulting increased pressure drop forces the piston, 20, further against the speed comparator spring, 19, thus applying a downward precompression to the speed correcting spring, 97, and the torque arm, 29, and actuators, 21, 22, then act via the leveller engine torque regulator to decrease the torque output of the leveller engine in order to decrease the speed of the shaft, 32, until it is restored to set speed. The reverse effects take place when shaft speed decreases. In this way, the speed sensor and comparator example shown in FIG. 2 functions by changing the value of speed correcting torque in the torque comparator which then acts via the actuators and the torque regulator to maintain a constant speed of the common final power output shaft, 32, as set into the speed comparator spring, 19.

As shown in FIG. 2, the speed comparator spring actually comprises the spring, 19, plus the speed correcting spring, 97, since they are connected together at one end. Interaction of the speed comparator and the torque comparator via this connection can be reduced as far as desired by use of high oil pressures in the oil pump, 17, by use of a large piston area of the piston, 20, or by use of both, so that the speed comparator spring, 19, is generating much stronger forces than the speed correcting spring, 97.

The value of set speed can be fixed into the pump, 17, displacement, the restrictor, 35, flow area, the piston, 20, area, and the spring, 19, design and position. Alternatively, the value of set speed can be made adjustable in various ways or combinations of ways as, for example:

a. the flow restrictor, 35, can be a valve whose flow area is adjustable via the valve handle, 40;
b. the oil pump, 17, can be positive displacement oil pump whose displacement can be adjusted, such as the common swash plate driven plunger pump whose swash plate angle is adjustable;
c. the stationary end of the speed comparator spring, 19, can be adjusted as via a threaded fitting, 41.

Such adjustment of the value of set speed can be made by hand or automatically in response to some requirement of the machine being driven.

The governor scheme shown in FIGS. 2 and 3 is a mechanical and hydraulic example governor using the torque comparator as the primary control acting on the engine torque regulator with the speed comparator acting to adjust this primary control.

Another particular example of a portion of this invention is shown in FIG. 4, with a cross section view of one of the deflection type torque sensor shown in FIG. 5. The engine torque sensor, 60, comprises driving members, 61, which drive driven members, 62, through springs, 63. The springs, 63, compress under the torque force and thus the gap between a driving member, 61, and the adjacent driven member, 62, opposite the spring, 63, is proportional to torque. The load torque sensor, 98, also located on the common power output shaft, 8, on the side of the flywheel, 99, opposite from the engine torque sensor, 60, operates in the same manner. The outputs of both torque sensors, 60, 98, are inputs to the comparator and controller, 100. The speed sensor of FIG. 4 comprises a ring gear, 64, with a very large number of magnetic material teeth, each of which actuates the counter pickup, 65, and hence these speed counts per unit of time are proportional to the speed of the common final output shaft, 8. The ring gear counts can also be counted for the time interval between passage of the driving member, 61, and passage of the adjacent driven member, 62, opposite the spring, 63, via the counter pickups, 66, 67, actuated by the magnetic material inserts, 68, 69, and these engine torque counts are proportional to torque in the common final output shaft, 8, between the engines and the flywheel, 99. These sensed speed counts per unit of time are compared electronically in the comparator, 100, against a set value of speed counts plus a torque correction counts and when sensed counts are less than a set value plus torque correction the controller, 100, energizes the increase solenoid valve, 71, which acts upon the leveller engine torque regulator to increase leveller engine torque and thus to speed up the common power output shaft, 8, toward the set speed. When sensed shaft speed counts are more than a set value plus torque correction, the controller, 100, energizes the decrease solenoid valve, 72, which acts upon the leveller engine torque regulator to decrease leveller engine torque and thus to slow down the common power output shaft, 8, toward the set speed. In this way, the speed of the common power output shaft, 8, is maintained steady at the set value. The set value of speed counts can be adjusted in the comparator and controller, 100, by adjusting the knob, 101, either by hand or automatically. The engine torque sensor counts are compared against the load torque sensor counts in the comparator, 100. When load torque counts exceed engine torque counts, a positive torque correction counts is put into the speed comparator whose value is increased positively as engine torque deficiency becomes larger. When engine torque exceeds load torque a negative torque correction counts is put into the speed comparator whose value is increased negatively as engine torque excess increases. Thus, when shaft speed is, for example, at set speed, the torque comparator acts via the speed comparator to keep engine torque equal to load torque. This electrical and electronic governor is an example of a governor using the speed comparator as the primary control acting on the engine torque regulator with the torque comparator acting to adjust this primary control.

The larger the mass moment of inertia of the governor flywheel about its axis of rotation, in general the closer the speed of the common power output shaft will hold to the set value. This results from the fact that the angular acceleration of the shaft and the flywheel and hence the extent of speed departure varies directly with the torque difference across the flywheel and inversely with the flywheel mass moment of inertia. Theoretically, an engine plant governor of this invention could hold common power output shaft speed constant without any speed departures since speed departures require the existence of a torque difference, and it is to these that this governor responds. But such perfect governor action would require torque sensors of perfect sensitivity and a controller and torque regulator response time of essentially zero. Nevertheless, the governor speed control can always be improved as needed by increasing the mass moment of inertia of the governor flywheel, by increasing the sensitivity of the torque and speed sensors, and by reducing the response time of the controller and engine torque regulator.

Having thus described my invention, what I claim is:

1. An engine governor for governing a group of engines, said group comprising at least one engine, all of said engines of said group being coupled to a single common power output shaft driving a load, said governor comprising:

means for regulating the torque output of at least one of said engines;

a flywheel and means for securing said flywheel to said common power output shaft between said engines and said load so that the rotational speed of said flywheel is always a fixed multiple of the rotational speed of said common power output shaft;

a first means for sensing the torque in that portion of said common final power output shaft between said flywheel and said load;

a second means for sensing the torque in that portion of said common final power output shaft between said flywheel and said engines;

means for sensing the speed of said common final power output shaft;

means for comparing sensed torques and speed responsive to said first torque sensor means, said second torque sensor means and said speed sensor means and operative upon said means for regulating torque so that: when first sensed torque exceeds sensed torque said torque regulator is adjusted to increase engine torque; when first sensed torque is less than second sensed torque, said torque regulator is adjusted to decrease engine torque; when shaft speed exceeds set speed said torque regulator is adjusted to decrease engine torque; when shaft speed is less than set speed, said torque regulator is adjusted to increase engine torque.

2. An engine governor for governing a group of engines, said group comprising at least one engine, all of said engines of said group being coupled to a single common power output shaft driving a load, as described in claim 1:

wherein said means for comparing sensed torques and speed comprises;

means to compare first sensed torque to second sensed torque and to adjust said torque regulator means so that: when first sensed torque exceeds second sensed torque plus a speed correcting torque, said torque regulator is adjusted to increase engine torque; when first sensed torque is less than second sensed torque plus a speed correcting torque, said torque regulator is adjusted to decrease engine torque;

means to compare sensed speed of said common power output shaft to set speed and to adjust said speed correcting torque so that: when shaft speed exceeds set speed, said speed correcting torque acts in the same direction as engine torque and is increased as excess speed increases; when shaft speed is less than set speed, said speed correcting torque acts oppositely to engine torque and is increased as speed deficiency increases.

3. An engine governor for governing a group of engines, said group comprising at least one engine, all of said engines of said group being coupled to a single common power output shaft driving a load, as described in claim 1:

wherein said means for comparing sensed torques and speed comprises:

means to compare sensed speed of said common power output shaft to set speed plus a torque correction speed and to adjust said torque regulator means so that: when shaft speed exceeds set speed plus a torque correction speed, said torque regulator is adjusted to decrease engine torque; when shaft speed is below set speed plus a torque correction speed, said torque regulator is adjusted to increase engine torque;

means to compare first sensed torque to second sensed torque and to adjust said torque correction speed so that: when first sensed torque exceeds second sensed torque, said torque correction speed is positive and is increased positively as second sensed torque deficiency increases; when second sensed torque exceeds first sensed torque, said torque correction speed is negative and is increased negatively as second sensed torque excess increases.

4. An engine plant comprising:

a primary engine whose torque and power may have a periodic variation and comprising a power output shaft;

a leveller engine, whose power generating capacity is at least equal to the maximum periodic variation of power of said primary engine, and comprising a power output shaft and a torque regulator means;

means for coupling said primary engine power output shaft and said leveller engine power output shaft to a single common final power output shaft;

a flywheel and means for securing said flywheel to said common power output shaft between said engines and said load so that the rotational speed of said flywheel is always a fixed multiple of the rotational speed of said common power output shaft;

a first means for sensing the torque in that portion of said common final power output shaft between said flywheel and said load;

a second means for sensing the torque in that portion of said common final power output shaft between said flywheel and said engines;

means for sensing the speed of said common final power output shaft;

means for comparing sensed torques and speed responsive to said first torque sensor means, said second torque sensor means and said speed sensor means and operative upon said means for regulating torque so that: when first sensed torque exceeds second sensed torque, said torque regulator is adjusted to increase engine torque; when first sensed torque is less than second sensed torque, said torque regulator is adjusted to decrease engine torque; when shaft speed exceeds set speed, said torque regulator is adjusted to decrease engine torque; when shaft speed is less than set speed, said torque regulator is adjusted to increase engine torque.

5. An engine plant as described in claim 4:

wherein said means for comparing sensed torques and speed comprises;

means to compare first sensed torque to second sensed torque and to adjust said torque regulator means so that: when first sensed torque exceeds second sensed torque plus a speed correcting torque, said torque regulator is adjusted to increase engine torque; when first sensed torque is less than second sensed torque plus a speed correcting torque, said torque regulator is adjusted to decrease engine torque;

means to compare sensed speed of said common power output shaft to set speed and to adjust said speed correcting torque so that: when shaft speed exceeds set speed, said speed correcting torque acts in the same direction as engine torque and is increased as excess speed increases; when shaft speed is less than set speed, said speed correcting torque acts oppositely to engine torque and is increased as speed deficiency increases.

6. An engine plant as described plant as described in claim 4:

wherein said means for comparing sensed torques and speed comprises:

means to compare sensed speed of said common power output shaft to set speed plus a torque correction speed and to adjust said torque regulator means so that: when shaft speed exceeds set speed plus a torque correction speed, said torque regulator is adjusted to decrease engine torque; when shaft speed is below set speed plus a torque correction speed, said torque regulator is adjusted to increase engine torque;

means to compare first sensed torque to second sensed torque and to adjust said torque correction speed so that: when first sensed torque exceeds second sensed torque, said torque correction speed is positive and is increased positively as second sensed torque deficiency increases; when second sensed torque exceeds first sensed torque, said torque correction speed is negative and is increased negatively as second sensed torque excess increases.

* * * * *

UNITED STATES PATENT AND TRADEMARK OFFICE

CERTIFICATE OF CORRECTION

PATENT NO. : 4,580,402

DATED : April 8, 1986

INVENTOR(S) : Joseph C. Firey

It is certified that error appears in the above-identified patent and that said Letters Patent is hereby corrected as shown below:

Col. 9 line 16: add -- second -- before the word sensed.

Col. 10 line 67: delete one of the group of words, "plant as described."

Signed and Sealed this

*Twenty-ninth* Day of *July 1986*

[SEAL]

*Attest:*

DONALD J. QUIGG

*Attesting Officer*

*Commissioner of Patents and Trademarks*